US005542473A

United States Patent [19]

Pringle et al.

[11] Patent Number: 5,542,473

[45] Date of Patent: Aug. 6, 1996

[54] SIMPLIFIED SEALING AND ANCHORING DEVICE FOR A WELL TOOL

[76] Inventors: Ronald E. Pringle, 12030 White Cap La., Houston, Tex. 77072; Charles L. Swan, 14554 Fair Knoll Way, Houston, Tex. 77062; Alan G. Schroeder, 3220 Three Sister Cir., Pearland, Tex. 77581

[21] Appl. No.: 459,222

[22] Filed: Jun. 1, 1995

[51] Int. Cl.[6] ..... E21B 23/00

[52] U.S. Cl. ..... 166/120; 166/134; 166/387

[58] Field of Search ..... 166/120, 134, 166/387, 382, 140, 217; 277/116.2, 120, 121, 191

[56] References Cited

U.S. PATENT DOCUMENTS

| | | | |
|---|---|---|---|
| 950,519 | 3/1910 | Stayman | 277/121 |
| 2,385,156 | 9/1945 | Nowell | 277/116 |
| 2,785,758 | 3/1957 | Baker | 166/120 |
| 3,386,515 | 6/1968 | Crow et al. | 166/120 |
| 3,386,520 | 6/1968 | Lawrence et al. | 166/120 |
| 4,588,029 | 5/1986 | Blizzard | 166/120 |
| 4,709,758 | 12/1987 | Preston, Jr. | 166/120 |
| 4,749,035 | 6/1988 | Cassity | 166/120 |
| 5,000,265 | 3/1991 | Pleasants et al. . | |
| 5,014,782 | 5/1991 | Daspit | 166/120 |
| 5,086,839 | 2/1992 | Setterberg et al. . | |
| 5,095,979 | 3/1992 | Perricone . | |
| 5,101,897 | 4/1992 | Leismer et al. . | |
| 5,146,993 | 9/1992 | Gambertoglio . | |
| 5,146,994 | 9/1992 | Pleasants et al. . | |
| 5,165,703 | 11/1992 | Morvant . | |
| 5,366,010 | 11/1994 | Zwart | 166/120 |

*Primary Examiner*—Frank Tsay

[57] ABSTRACT

A resilient sealing element is adapted for connection to a well tool, with an integral anchoring device, such as a slip, embedded therein. When compressive forces are applied thereto the sealing element compresses and moves its outside diameter and the slip into sealable engagement with the inside wall of a well tubing or casing. Releasing the sealing and anchoring element is accomplished by applying tension to a wire which passes longitudinally therethrough to cause retraction of the slip.

11 Claims, 5 Drawing Sheets

SECTION "A-A"

SIMPLIFIED SEALING AND ANCHORING DEVICE FOR A WELL TOOL

BACKGROUND OF THE INVENTION

1. Field of the Invention

The present invention relates to devices used on packers, bridge plugs and packoffs which are required to engage, anchor and seal inside a downhole casing or tubing.

2. Description of Related Art

Packers, bridge plugs, and packoff devices create an annular volume between a well casing and a well tubing, and provide a means to seal and block and/or direct flow of produced wellbore fluids. These devices are "set" by activating an anchoring mechanism, commonly referred to as a "slip" (or in plurality as "slips") to affix the device to the inside of the casing, and to compress a sealing member, commonly referred to as an "element", into sealable engagement with the inside wall of the casing. Typical embodiments of these devices include a conical wedge, driven with force under a slip, and are generally left in place for extended periods of time, and can be difficult to release due in part to the rigidity of the parts, the presence of corrosive well fluids and ambient debris. Time, heat from the well, debris and corrosion can cause the similar metallurgy to foul, lock, and/or bind together making retrieval of the packer from the well very difficult. Additionally, the cost of a downhole tool generally increases with the number of parts, the overall length, and design complexity. Reduction of parts translates to reduced cost, and increased reliability of the operational characteristics of the mechanism.

Specifically, in some packers a hydraulically operated piston is integral to the anchoring mechanism, and utilizes hydraulic pressure usually applied inside the tubing to activate the setting mechanism. Slips typically engage an interior surface of the well casing or tubing by a series of hardened teeth which lock the packer in position. These hydraulically set packers employ a concentric hydraulic piston, and pressure acting on such translates to an axial force, which in turn acts on an annular cone. The cone coacts with a mating conical surface on the slips. Axial movement of the cone causes the slips to move radially outward to engage the interior surface of the casing. This same axial movement of the hydraulic piston is commonly used to compress an elastomeric element array into sealable engagement with the inside diametrical wall of the casing. U.S. Pat. No. 5,146,994 discloses this configuration. Other and further methods of applying the axial force necessary to anchor and seal the device are shown in U.S. Pat. No. 5,086,839, whereby a set of drag springs are employed to set the disclosed packer; U.S. Pat. No. 5,095,979 discloses how a packoff may be deployed on coiled tubing and set using drag springs; U.S. Pat. No. 5,000,265 discloses how a packoff may be hydraulically set on coiled tubing; and U.S. Pat. No. 5,146,993, which illustrates a packing element utilized on packers, bridge plugs and packoffs.

While these applications, usage and configurations are novel and diverse, common constituent parts include a resilient packing element, at least one independent set of slips, with an interior conical surface that coacts with a separate exterior conical wedge. Axial motion is required to drive the conical wedge under the slips, which are, by such motion, driven radially outward into engagement with the tubing or casing. The interaction of this multiplicity of parts gives rise to the numerous problems described above.

There is a need for a novel, simplified sealing and anchoring device which reduces the number of parts to anchor and seal a packer, bridge plug or packoff in a well; and will maintain a reliable seal while set; and is more reliably retrieved than devices in current use.

SUMMARY OF THE INVENTION

The present invention has been contemplated to overcome the foregoing deficiencies and meet the above described needs. Specifically, the present invention is a resilient sealing element for a well packer, bridge plug or packoff that has an integral anchoring device, such as a slip embedded therein. In one preferred embodiment, the sealing element is contained on either end by anti-extrusion rings, and a tensile member, such as a wire, and runs longitudinally through the anti-extrusion rings, through the resilient element, and through a hole in the slip. When compressive forces are applied, the element compresses and moves its outside diameter, the slip, and the anti-extrusion rings into sealable engagement with the inside wall of a well tubing or casing. Releasing the sealing and anchoring element is accomplished by applying tension to the wire causing retraction of the slip to its original position.

The sealing and anchoring device of the present invention reduces the number of parts required to anchor and seal a well tool in a casing, and reduces the overall length of the supporting assembly thereby reducing cost and enhancing well economics. Fewer parts also translates to increased reliability while retrieving the mechanism, by decreasing the likelihood that well conditions and chemistry will foul the mechanism over time.

DETAILED DESCRIPTION OF THE PREFERRED EMBODIMENTS

The present invention is a simplified sealing and anchoring device for well tools, such as packers, bridge plugs and packoffs. For the purposes of the present discussion, the present invention will be described in conjunction with its use in a well packer for purposes of illustration only. It is to be understood that the described sealing and anchoring device can be used in other well tools, such as bridge plugs, or packoffs, or may be used on tools deployed on coiled tubing, or any other such tools that would benefit from a simple, low cost, reliable method of sealing and anchoring.

For the purposes of this discussion, the terms "upper" and "lower", "up hole" and "downhole", and "upwardly" and "downwardly" are relative terms to indicate position and direction of movement in easily recognized terms. Usually, these terms are relative to a line drawn from an upmost position at the surface of the earth to a point at the center of the earth, and would be appropriate for use in relatively straight, vertical wellbores. However, when the wellbore is highly deviated, such as from about 60 degrees from vertical, or horizontal these terms do not make sense and therefore should not be taken as limitations. These terms are only used for ease of understanding as an indication of what the position or movement would be if taken within a vertical wellbore.

Specifically, the sealing and anchoring device of the present invention includes; a resilient element; at least one anchoring device, commonly called a slip; at least one anti-extrusion ring positioned at either end of the resilient element; and at least one wire member extending longitudinally through each constituent part. Compression of the element moves the slip, the element, and the anti-extrusion rings into sealable engagement with the inside diametrical wall of a well tubing or casing. Since the resilient element is completely contained by the casing, the anti-extrusion rings, and a mandrel on the well tool, increased compression applied to the sealing and anchoring element results in an internal pressure on the resilient element. This internal pressure forces the slip to contact and slightly imbed in the well casing, thereby firmly anchoring the well tool to the casing, and also causing the resilient member to form a fluidic seal.

Releasing the packer which has been thus set requires releasing the compressive energy stored and retained in the element during setting, and applying a tensile force to the wire tensile member. This tensile force results in a radially inward retractive force on the slip and the resilient element, causing a release from sealable engagement within the casing.

Figure 1A:
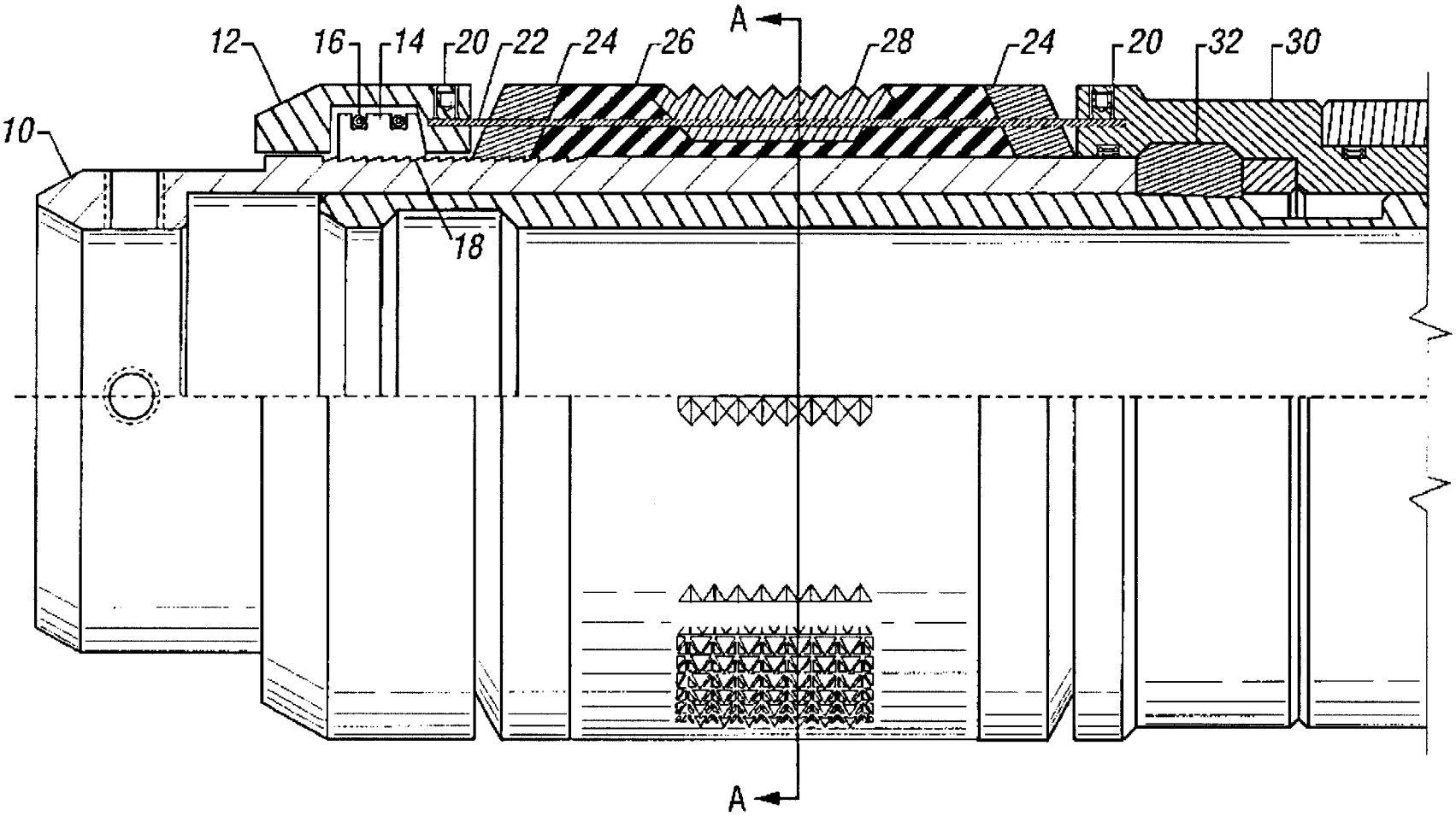
FIGS. 1 A–B taken together are a longitudinal half cross section of one preferred embodiment of an annular sealing and anchoring element of the present invention, shown on a well packer in the "running" or unset position.
Figure 1B:
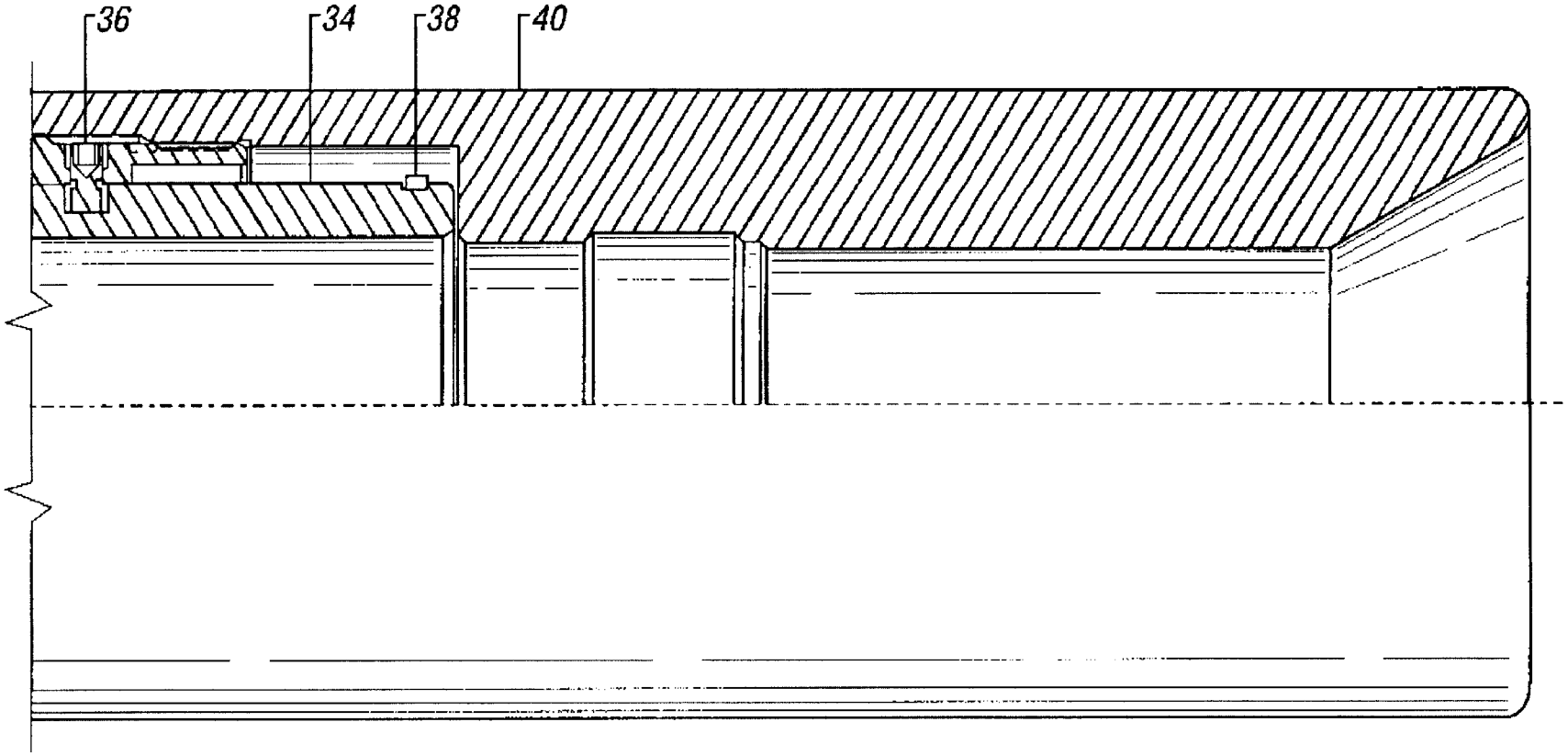

Referring now to FIGS. 1 A–B, a packer includes a mandrel 10 and is disposed longitudinally through the inside diameter of a cylindrical ratchet housing 12. A set of annular ratchets 14, which have a ratchet tooth profile 18 formed on a side adjacent to the mandrel 10, to allow movement of the ratchets 14, and the ratchet housing 12 in a single, longitudinally downward direction only. A garter spring 18 applies a radially inward force on the ratchets 14 to assure engagement of the ratchets 14, and the profile 16 in a matching profile formed on the outside diameter of the ratchet housing 12. A set screw 20 retains a wire 22 in the ratchet housing 12 on one end, and a annular compression ring 30 on the other. The wire 22 is threaded through a small hole in each of two anti-extrusion rings 24, a resilient element 26, and a slip 28. In this preferred embodiment, five individual radially disposed slips are disclosed, but the actual number, from one to a several multiples, is determined by the size of the packer and the pressure rating thereupon, since the retention ability is determined, in part, by the number of slips opposing the native forces in the well. Also, the anti-extrusion devices, while preferred, may not be necessary in some instances.

The compression ring 30 is held in locked position by a dog 32, the dog being supported and held in radial position by an inner mandrel 34. The inner mandrel 34 is held in fixed axial position by a frangible shear pin 36, which is threaded into the mandrel 10. A shear ring 38 is connected to the lower end of the ratchet mandrel 18 and provides a lower shoulder for the compression ring 30. A lower sub 40 is connected to the ratchet mandrel 18, and holds the assembly together. The packer is lowered into the well as shown in this position, and set in a well casing 42 utilizing a well known packer setting tool (not shown), the setting operation of which is heretofore described.

Figure 2A:
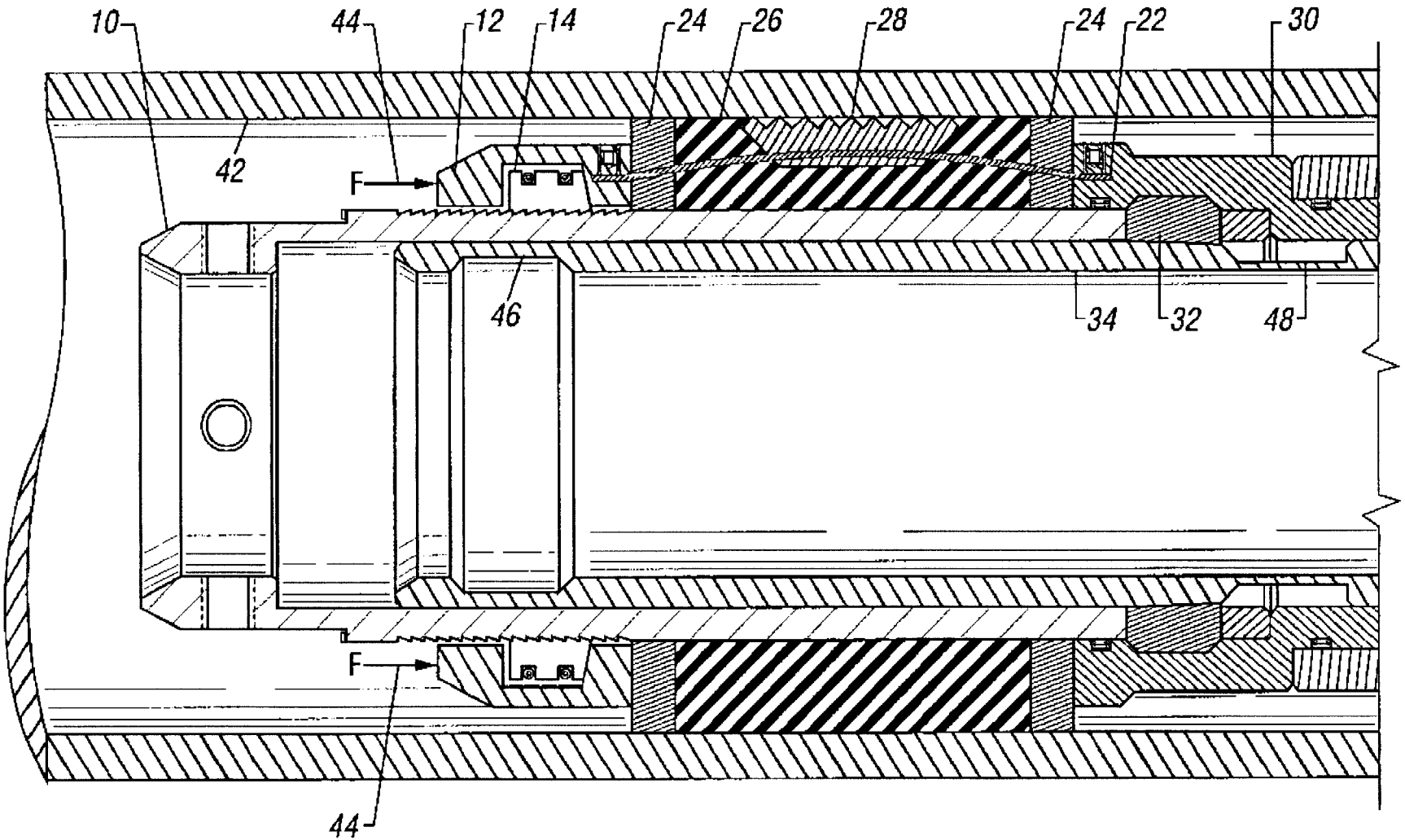
FIGS. 2 A–B taken together are a longitudinal half cross section of the annular sealing and anchoring element of FIG. 1, shown on a well packer and "set", or deployed in a tubular casing.
Figure 2B:
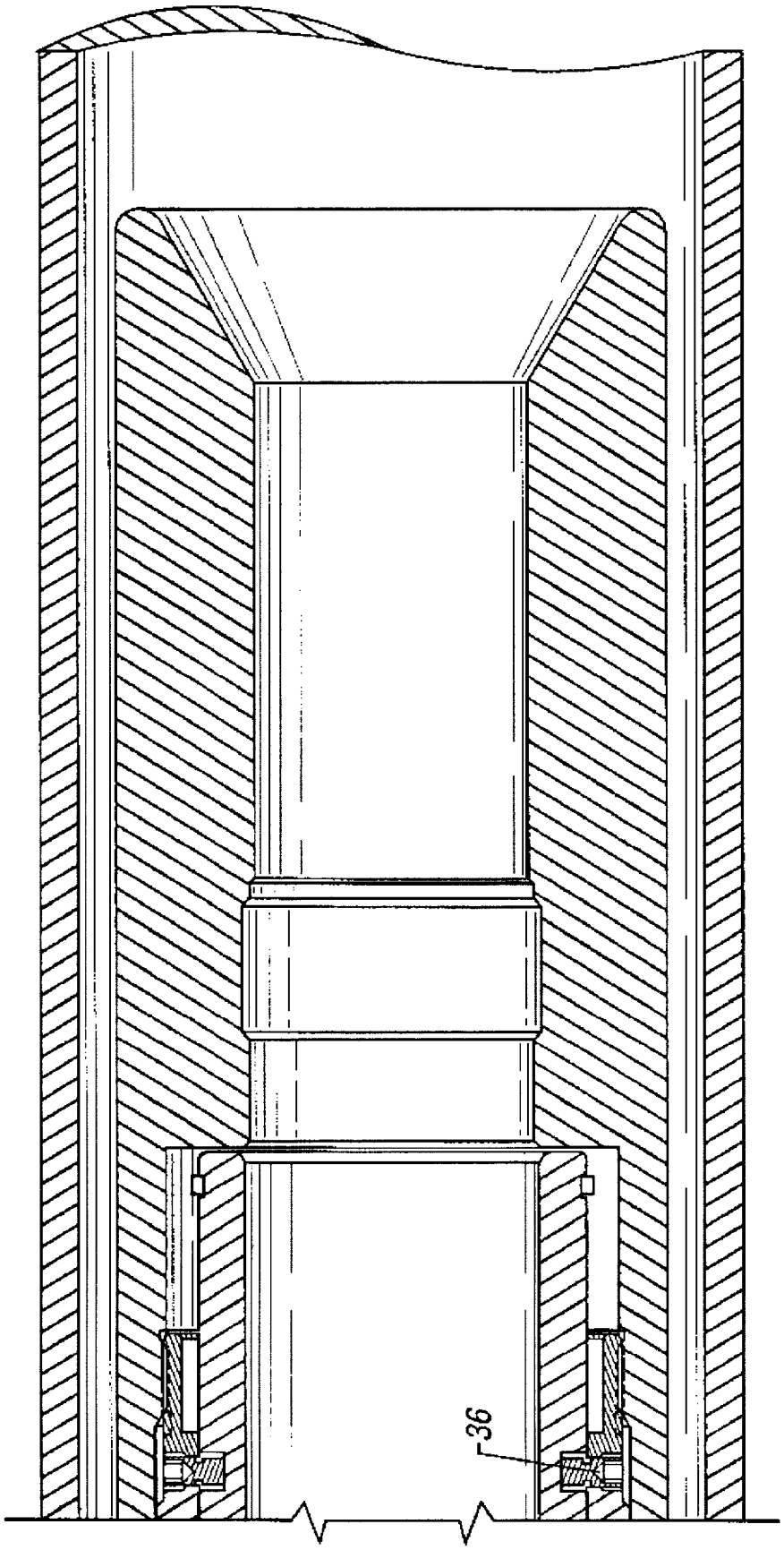

Referring now to FIGS. 2 A–B, the packer of the present invention is shown set in a well casing 42, by application of a compressive force 44 from the packer setting tool (not shown), applied to the ratchet housing 12. The ratchet housing 12 moves the ratchets 14, to compress the anti-extrusion rings 24 to close any annular gap through which the resilient element might extrude, between the packer, and the casing 42, thereby totally confining the resilient element 26. The compressive force 44 also acts on the resilient element 26, which moves radially outward, likewise moving the slip 28 radially outward to a sealed and anchored condition. The slip 28 may be circular, or polygonal, and may have ridges, bumps, teeth, or other such friction enhancing shapes on the outer surface. Further, slips 28 may have a smooth or rough underside, and may have bevels, grooves, fillets, radii or other shapes to enhance the adherence of the slip 28 to the resilient element 26, to facilitate movement of the slip 28, or to engage or disengage the slip 28 from the wall of the casing 42.

The slip 28 is to be embedded and bonded in the resilient element 26, preferably by molding, but adhesive bonding, such as with a glue, or mechanical bonding, such as with screws or retainer clips, are within the scope and spirit of the present invention. The outside gripping portion of the slip 28 may be tangent to the outside diameter of the resilient element 26, or may be totally encased in the material of the resilient element 26, may be totally exposed, or may be partially encased and partially exposed, and still be within the scope and spirit of the present invention.

Setting the packer requires compressive energy to be applied to the assembly, and once so applied is captured between the anti-extrusion rings 24, which are themselves retained by the ratchet 14, ratchet housing 12, and the compression ring 30. Another result of the described compression moves the wire 22, into a non-linear or buckled position as the slip 28 travels radially outward to engage the casing 42 and the compressive forces act on each end of the wire. While a wire 22 is preferred as a tensile member, other shapes, like flat bands, rods or bars may also be used to apply tension, and disengage the resilient element 26 and the slip 28 from the casing 42. Alternatively, non-continuous shapes may be affixed or machined into the compression ring 30 and ratchet housing 12 that enable tensile force from a pulling tool to be transferred to the resilient element 26 and the slip 28 to affect disengagement.

While a figure showing the sealing and anchoring device in the "unset", or released position is not shown specifically in any of the attached figures, the retraction of the slip 28 and the resilient element 26 is easily visualized by examining FIG. 2 A–B with a brief explanation. A pulling tool (not shown) which is well known to those skilled in the art, is lowered in the well to a position adjacent to an internal fishing neck 46 in the upper end of the inner mandrel 34. The pulling tool is disposed as to latch in the internal fishing neck 46, and apply an axially upward jarring force. This force shears the shear pin 36, allowing the inner mandrel 34 to move axially upward with the pulling tool. A groove 48 in the inner mandrel 34 aligns with the dog 32, resulting in a radially inward retraction of the dog 32. The compression ring 30 is now free to move axially downward, applying tension to the wire 22. Tensile force applied to the wire pulls the slip 28, and the resilient element 26 away from sealed engagement with the casing 42, releasing the packer and allowing retrieval from the well.

Figure 3:
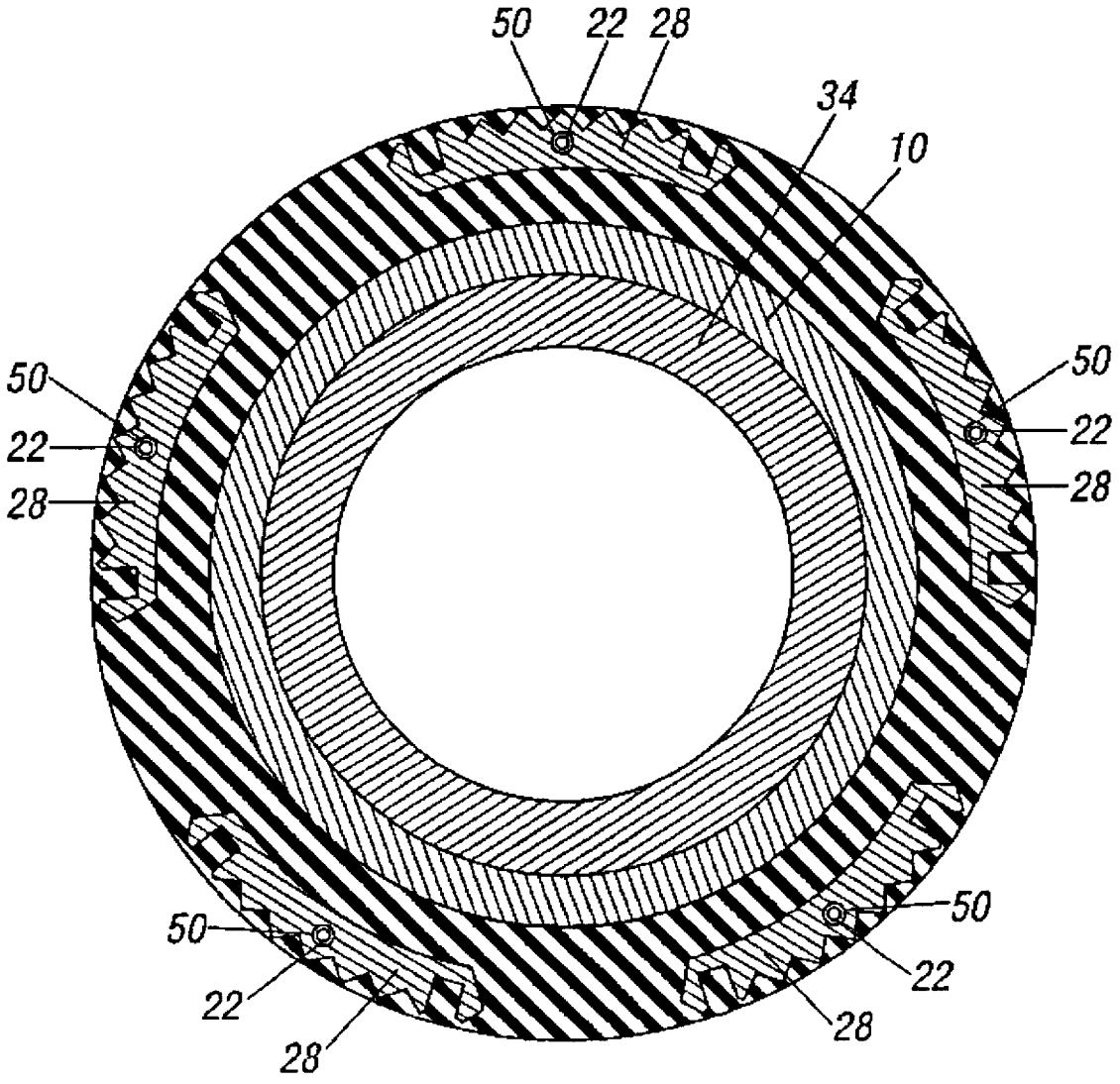
FIG. 3 is a radial cross section of FIG. 1-A shown at line "A—A", which illustrates the radial orientation of an array of slips, a resilient element, and a tensile member used in one preferred embodiment of the present invention.

FIG. 3 is a radial cross section of the present invention at section "B—B", and in this embodiment illustrates the orientation of the slips 28 embedded in the resilient element 26. Further, the wire 22 is shown in a hole 50 passing through each slip 28.

The present invention, has clear advantages over the prior art, when used on packers, bridge plugs, packoffs, or other devices that benefit from a simple and reliable device to seal and anchor well tools in a casing or tubing. Prior art sealing and anchoring devices are distinctly separate, requiring lengthy, complex mechanisms to separately anchor and seal. The number of parts needed to seal and anchor in the present invention is reduced over the prior art, as is the overall length of the assembly, thereby reducing the overall cost. With the reduction of the number of parts, comes the advantage of reduced complexity of the mechanism which increases the setting and releasing reliability of the mechanism. Eliminating the metallic wedging cone/slip anchoring mechanism of the prior art, excludes the possibility of corrosive bonding, or debris fouling of the mechanism over time, assuring reliable retrieval.

Whereas the present invention has been described in particular relation to the drawings attached hereto, it should be understood that other and further modifications, apart from those shown or suggested herein, may be made within the scope and spirit of the present invention.

What is claimed is:

1. An annular sealing and anchoring element for connection to a downhole tool, comprising:

a cylindrical resilient sealing element; and at least one anchoring device embedded in an exterior longitudinal surface of said resilient sealing element, and adapted to be moved outwardly into engagement with a well tubular upon compression of the sealing element.

2. The annular sealing and anchoring element of claim 1 and including first and second annular anti-extrusion rings adjacent to first and second ends of said annular sealing element.

3. The annular sealing and anchoring element of claim 2 wherein said first and second anti-extrusion rings are bonded to a first and a second end of said sealing element.

4. The annular sealing and anchoring element of claim 2 wherein at least one tensile member extends longitudinally through said sealing element, and through at least one of said anti-extrusion rings.

5. The annular sealing and anchoring element of claim 4 wherein said tensile member is a wire.

6. The annular sealing and anchoring element of claim 2 wherein said anti-extrusion rings comprise compressed wire mesh.

7. The annular sealing and anchoring element of claim 2 wherein said anti-extrusion rings comprise substantially rigid and malleable homogenous material.

8. The annular sealing and anchoring element of claim 1 wherein said anchoring device includes a series of sharpened edges, points or ridges.

9. An annular sealing and anchoring element to be carried on a downhole tool, comprising:

a cylindrical resilient sealing element adapted to be carried on a downhole tool;

a plurality of anchoring devices embedded in and spaced radially about an exterior longitudinal surface of said resilient sealing element;

first and second annular anti-extrusion rings spaced adjacent to respective first and second ends of said annular sealing element; and a plurality of tensile members, with each of said tensile members extending longitudinally through said sealing element, through a one of said anchoring devices, and through said first and second anti-extrusion rings.

10. The annular sealing and anchoring device of claim 9 wherein said plurality of anchoring devices, said sealing element, and said anti-extrusion rings are adapted to be moved outwardly into engagement with a well tubular member upon compression of said sealing element.

11. The annular sealing and anchoring device of claim 10 wherein said plurality of anchoring devices, said sealing element, and said anti-extrusion rings are adapted to be moved inwardly upon the application of tension to said plurality of tensile members.

* * * * *